United States Patent [19]

Decker

[11] Patent Number: 5,066,198

[45] Date of Patent: Nov. 19, 1991

[54] GAS LIFT VALVE

[75] Inventor: Kenneth L. Decker, Garland, Tex.

[73] Assignee: Otis Engineering Corporation, Dallas, Tex.

[21] Appl. No.: 533,019

[22] Filed: Jun. 4, 1990

[51] Int. Cl.[5] ..... F04F 1/18

[52] U.S. Cl. ..... 417/54; 417/113; 417/116

[58] Field of Search ..... 417/54, 55, 109, 111, 417/112, 113, 114, 115, 116; 137/155

[56] References Cited

U.S. PATENT DOCUMENTS

| | | | |
|---|---|---|---|
| Re. 25,292 | 12/1962 | Dudley | 137/155 |
| 2,385,316 | 9/1945 | Walton . | |
| 2,642,811 | 6/1953 | Fletcher . | |
| 2,642,812 | 6/1953 | Robinson . | |
| 2,691,383 | 10/1954 | Church | 417/111 |
| 2,994,335 | 8/1961 | Dudley | 137/155 |
| 3,086,593 | 4/1963 | Chitwood | 166/224 |
| 3,105,509 | 10/1963 | Moore, Jr. | 137/102 |
| 3,125,113 | 3/1964 | Lamb et al. | 137/155 |
| 3,143,128 | 8/1964 | Bicking, Jr. | 137/155 |
| 3,183,922 | 5/1965 | Lamb et al. | 137/155 |
| 3,311,126 | 3/1967 | Dudley | 137/155 |
| 3,311,127 | 3/1967 | Dudley | 137/155 |
| 3,326,229 | 6/1967 | Dudley | 137/155 |
| 3,386,391 | 6/1968 | Garrett . | |
| 4,165,857 | 8/1979 | Morris et al. | 251/54 |

*Primary Examiner*—Richard A. Bertsch
*Assistant Examiner*—Charles Freay
*Attorney, Agent, or Firm*—Albert W. Carroll

[57] ABSTRACT

A gas lift valve of the unloading type having a main valve for controlling fluid flow between a well casing and a well tubing, a volume of compressible liquid a spaced distance from said main valve and subject to casing pressure, and a pilot valve between the main valve and the compressible liquid for controlling opening and closing of the main valve by permitting casing pressure to act thereon or to isolate it therefrom as the volume of the compressible liquid changes in response to changes in casing pressure to which it is subjected. Gas lift well systems utilizing such gas lift valves and methods for operating such gas lift well systems are also disclosed.

27 Claims, 4 Drawing Sheets

GAS LIFT VALVE

BACKGROUND OF THE INVENTION

1. Field of the Invention

This invention relates to wells, especially wells such as oil wells which are produced through use of gas injected into the well at the surface to aid in lifting oil and/or other liquids to the surface, and particularly relates to valves for controlling the admission of such gas into the oil and/or other liquids at a subsurface location.

2. Related Art and Information

Gas lift valves have been used for many years to aid in the production of oil wells lacking sufficient natural pressure to flow naturally without assistance. Such valves commonly control the admission of lift gas into the well tubing from the well casing to aid in lifting formation liquids to the surface. Lift gas is generally injected into the well casing at the surface. Several types of gas lift valves have been known. Some gas lift valves open in response to casing pressure, some in response to tubing pressure, some admit gas into the tubing continuously, other under certain conditions. Some gas lift valves, for instance, are provided with main valves which are pilot actuated, that is, when their pilot valves open, their main valves are caused to open, and when their pilot valves close, their main valves close in response thereto. The pilot valve may respond to casing pressure or to tubing pressure or to the difference between those two pressures.

Listed here are certain U.S. patents which disclose prior gas lift valves which may be pertinent to the invention disclosed and claimed in this present application.

Re. No. 25,292 2,385,316 2,642,811 2,642,812
2,994,335 3,086,593 3,105,509 3,125,113
3,143,128 3,183,922 3,311,126 3,311,127
3,326,229 3,386,391

U.S. Pat. No. 2,385,316 which issued on Sept. 18, 1945 to Robert 0. Walton discloses a gas lift valve having a main valve 29 for controlling flow of lift gas into the tubing from the casing. Main valve 29 has a bellows 30 the interior of which is exposed to casing pressure through passage 32. Pilot valve 38 normally prevents casing pressure from bellows 30 from bleeding off into the tubing. Pilot valve 38 is pressed by spring 48 toward closed position. A second bellows 44 attached to the pilot valve is exposed to tubing pressure. When tubing pressure rises to a predetermined level, the bellows 44 overcomes the force of spring 48 and unseats pilot valve 38. This causes casing pressure to bleed from bellows 30 of the main valve faster than small passage 32 can replenish the casing pressure and the main valve opens. Pilot bellows 44 is almost filled with an incompressible liquid which permits limited compression of the bellows and which protects it from damage (crushing) by excessive pressure.

U.S. Pat. No. 2,642,811 issued to C. D. Fletcher on June 23, 1953. This patent discloses a well flow apparatus and system, the heart of which is a gas lift valve. This gas lift valve is pilot operated. The pilot valve 25 has a spring 27 normally holding it in closed position. It also has a bellows 23 which is exposed to casing pressure. When the casing pressure rises to a sufficiently high level, the bellows 23 is compressed, overcoming the force of spring 27 and unseating pilot valve 25. This allows casing pressure into bore 30 and to act upon the exterior of bellows 32 to compress the same and open the main valve 38 to permit lift gas to flow from the casing into the tubing through passage 41. When casing pressure is reduced sufficiently, the pilot valve will no longer be held open thereby and will close. This excommunicates the bellows 32 from casing pressure and the casing pressure exterior of this bellows will soon bleed through port 37 of the bellows sufficiently to cause the main valve to close. This gas lift valve has the pilot bellows almost filled with liquid to permit limited compression of the bellows but also protect the bellows from being damaged by overpressuring.

U.S. Pat. No. 2,642,812 issued to A. I. Robinson on June 23, 1953. This patent is a well flow apparatus which utilizes two gas lift valves of the pilot operated type. The first valve (FIG. 2) is of virtually the same structure as that disclosed in U.S. Pat. No. 2,642,811 just discussed and operates in the same manner to transfer lift gas from the casing into the tubing. The pilot of gas lift valve D1 of FIG. 2 has its pilot bellows exposed to casing pressure. The device El of FIG. 4 of U.S. Pat. No. 2,642,812 is the same structure as the valve D1 but transfers lift gas outwardly from an input conduit to an outer conduit. This is commonly done, but generally lift gas is transferred from an annulus inwardly into the tubing. Again, liquid is used in the pilot bellows to protect it from crushing under excessive pressures. Both such valves are used in a plural well where an annulus is used for supplying lift gas to both valves, one of which transfers gas into the tubing and the other of which transfers gas into an outer annulus.

U.S. Pat. No. 2,994,335 issued to W. A. Dudley on Aug. 1, 1961 and its reissue Patent Re. No. 25,292 issued on Dec. 4, 1962, disclose a gas lift valve which has a pilot valve with a bellows and spring, the spring for biasing the pilot valve toward closed position and the bellows, exposed to casing pressure for moving the pilot valve toward open position. When casing pressure rises to a predetermined value the bellows lifts the pilot valve to open position in opposition to the spring. When the pilot valve opens casing pressure enters through the pilot valve to act upon the main valve and move it to open position against the force of its spring to allow transfer of lift gas into the tubing. When the casing pressure falls below a predetermined value the pilot valve will close and this will result in the main valve closing, it being moved by its spring.

U.S. Pat. No. 3,086,593 which issued on Apr. 29, 1963 to C. B. Chitwood discloses a gas lift valve having a pilot valve including a bellows attached to the pilot valve member and charged with a compressed gas. The bellows hold the pilot valve on its seat (closed) when the casing pressure to which it is exposed is below a predetermined level. When the casing pressure rises above such predetermined level, the bellows will be compressed and will unseat (open) the pilot valve. Opening the pilot valve allows casing pressure to move the main valve to open position against the compression of its spring. When casing pressure falls below the predetermined level, the pilot valve closes, whereupon the main valve is returned to closed position by the spring.

U.S. Pat. No. 3,105,509 issued Oct. 1, 1963 to H. H. Moore, Jr. and discloses a gas lift valve for chamber lift operations. The valve is pilot operated. It has a pilot mechanism which includes a pilot valve 35 movable between closed and open positions by a bellows 37 attached thereto. The bellows is charged with pressurized gas. The bellows is exposed to casing pressure at all times. When casing pressure rises to a predetermined level it compresses the bellows and opens the pilot valve. This allows casing pressure to move the main valve 27 to open position against the force of spring 30. When the pilot valve closes, the main valve will quickly close. The bellows is charged with a pressurized gas.

U.S. Pat. No. 3,143,128 issued to Lewis J. Bicking on Aug. 4, 1964. This patent discloses a pilot operated valve. Pilot valve 45 is held on seat 44 by spring 48. Casing pressure admitted through port 38 and vertical passage 39 occupies the spring chamber when the pilot valve is seated. Casing pressure is also allowed to enter port 55 and surround the bellows 46. When casing pressure rises above a predetermined pressure, bellows 46 attached to pilot valve 45 will compress and unseat the same and pressure in the spring chamber will bleed through seat 44 faster than it can enter through port 38 and passage 39. This decreases the pressure above piston 36 from which main valve 33 is depended. Casing pressure, communicated through ports 25 will readily lift the main valve to full open position to allow fluid flow through ports 25, bore 27, and exit ports 28 into the tubing. The contents of the bellows is not found to be specified.

U.S. Pat. No. 3,183,922 which issued May 18, 1985 to C. P. Lamb, et al., discloses a pilot operated gas lift valve. The pilot valve (ball 72) is held on seat 71 by pilot spring 74 and bellows 63. The bellows is exposed to tubing pressure conducted thereto through outlet 21, main valve stem bore 34, and passage 62. Casing pressure is communicated to the ball and seat via passage 59. When casing pressure increases to a predetermined value, ball 72 will be unseated and casing pressure flowing through the seat will pass through passage 62 and will be applied to piston 35 to thus move it down in opposition to main valve spring 44. Main valve 48 attached to the piston will thus be unseated and moved to its open position. When the casing pressure falls to a predetermined value, the pilot spring and the bellows will return the ball 72 to its seat to bar further entry of casing pressure. This will allow tubing pressure to equalize on upper and lower sides of the piston and permit spring 44 to close the main valve. It is not stated that the bellows contains anything.

U.S. Pat. No. 3,311,126 which issued to William A. Dudley on Mar. 28, 1967 and discloses a pilot operated gas lift valve. This device has a pilot valve 60 which engages seat 70. Pilot spring 75 biases the pilot valve towards its seat. A bellows 72 is also connected to the pilot valve. Port 69 communicates casing pressure into the pilot valve chamber. When casing pressure reaches a selected level, the bellows 72 compresses, overcomes spring 75, and lifts pilot valve 68 off its seat. Casing pressure then flows through seat 70 and its passage 71 into the chamber (47) therebelow where it acts upon piston (18). The piston is thus depressed, compressing spring 55 and opening the main valve 17 to permit flow of lift gas from the casing into the tubing through inlet screen 38, inlet ports 37 and through bores 42 and 43, to exit through outlet ports 39. When the casing pressure falls below the selected level, pilot valve 68 closes, chamber (47) is shut off from the casing pressure and becomes equalized with tubing pressure, the excess pressure bleeding to the tubing through bore 64 of the piston (18) and its stem 17. With pressures equalized above and below the piston, main valve spring 55 moves the main valve to closed position.

U.S. Pat. No. 3,311,127 issued on Mar. 28, 1967 to William A. Dudley. This patent discloses pilot operated gas lift valve wherein unseating of the trigger valve 31, FIG. 3, results in the opening of the pilot valve 42 and of the main valve 23 for a selected period to permit flow of fluids from the inlet 19 to the outlet 21. To maintain the main valve 23 open for this selected time, an incompressible liquid, contained between a spring pressed lower pressure responsive member 35 and a spring pressed upper pressure responsive member 53 is metered through passages in the partition 48 between them. The rate of flow through these passages is adjusted by needle valves. When the trigger valve 31 is seated again, the main valve 23 will close.

U.S. Pat. No. 3,326,229 which issued on June 20, 1967 also to William A. Dudley discloses a gas lift valve which appears to be the same as that illustrated and described in his just mentioned Pat. No. 3,311,127.

U.S. Pat. No. 3,386,391 which issued to Henry U. Garrett on June 4, 1968 discloses a gas lift valve and systems and methods for unloading wells equipped therewith. The gas lift valves disclosed and claimed are not pilot operated valves, they open in response to tubing pressure and close in response to casing pressure, they are provided with means for latching the valve member in its open position automatically upon its reaching full open position. The latching means is releasable responsive to a decrease in casing pressure to a predetermined low value, whereupon the valve members move to closed position and afterwards will not open in response to casing pressure. The methods are described as unloading a well automatically and needs no attention or clock controls as it will completely unload and come back to operating pressure for either testing or normal operation if desired.

There was not found in the known prior art a pilot operated gas lift valve having therein a body of compressible liquid therein and an associated mechanism including means sensitive to such liquid's volumetric changes due to changes in pressures acting thereon for actuating the pilot valve to control opening and closing of the main valve. Neither was there found any system utilizing such gas lift valves, nor any method for unloading and operating a well equipped with such gas lift valves and system.

The present invention is an improvement over known gas lift valves of the unloading type, as well as known systems and methods relating thereto.

SUMMARY OF THE INVENTION

The present invention is directed toward a gas lift device for controlling fluid flow between the exterior and the interior of a well tubing, the device having a body with an inlet, an outlet, and a flow course extending therebetween, a main valve controlling flow through said flow course, means biasing the main valve toward closed position, and a pressure responsive area thereon for moving the main valve to open position, a chamber in the body for containing a body of compressible liquid responsive to variations in casing pressure, a pilot valve between the liquid chamber and the main valve for controlling admission of casing pressure to the pressure responsive area of the main valve in response to compression of the compressible liquid in the chamber, and means for securing the gas lift valve in a well tubing and for sealing between the device and the well tubing both above and below the inlet.

The well installation of this invention includes a well casing extending between the surface and an earth production zone, a well tubing in the casing providing an annulus therebetween, a packer sealing the annulus above the production zone, a wellhead sealing the annulus at the surface, a plurality of spaced-apart unloading valves in the well tubing for controlling the flow of fluids from the annulus to the interior of the well tubing, the unloading valves being identical each with the other and not adjusted with respect to pressure, depth, or temperature, each of the valves being openable and closable in response to increases and decreases in annulus pressure, a passage between the annulus and well tubing a spaced distance below the lowermost of the valves for the transfer of fluids from the annulus into the well, and a source of pressurized gas connected to the annulus at the surface.

The methods of this invention for placing a well on gas lift include assembling a well tubing and placing it in a casing to form an annulus therebetween, the well tubing including a packer near its lower end, an orifice a spaced distance above the packer for communicating the annulus with the interior of the well tubing, a plurality of unloading valves spaced above the orifice and spaced from each other and from the surface, the unloading valves being placed in the well tubing without adjustment relative to depth, pressure, or temperature, actuating the packer to seal the annulus at a location above the production zone, sealing the annulus at the surface, communicating the annulus with a source of pressurized gas, and injecting pressurized gas into the annulus at a rate of about 150 percent of the flow capacity of one of the plurality of unloading valves and opening the upper end of the well tubing to permit flow therefrom until gas is finally injected through the orifice, then reducing the gas injection rate to a predetermined rate for gas lifting liquids from the well.

It is therefore one object of this invention to provide an improved gas lift valve of the unloading type which is operated by a pilot valve sensitive to volumetric changes in a compressible liquid associated therewith as it responds to variations in pressure acting thereon.

Another object of this invention is to provide a gas lift valve of the character described which requires no adjustment with respect to depth, pressure, or temperature.

Another object is to provide gas lift valves of the character described which can be installed in a well in random order.

Another object is to provide a gas lift valve of the character described in which the compressible liquid therein is silicone fluid.

Another object is to provide a well installation in which a plurality of gas lift valves of the character described are utilized.

Another object of this invention is to provide methods for unloading and operating well installations utilizing gas lift valves of the character described.

Other objects and advantages will become apparent from reading the description which follows and from studying the accompanying drawing, wherein:

DESCRIPTION OF THE PREFERRED EMBODIMENTS

Figure 1:
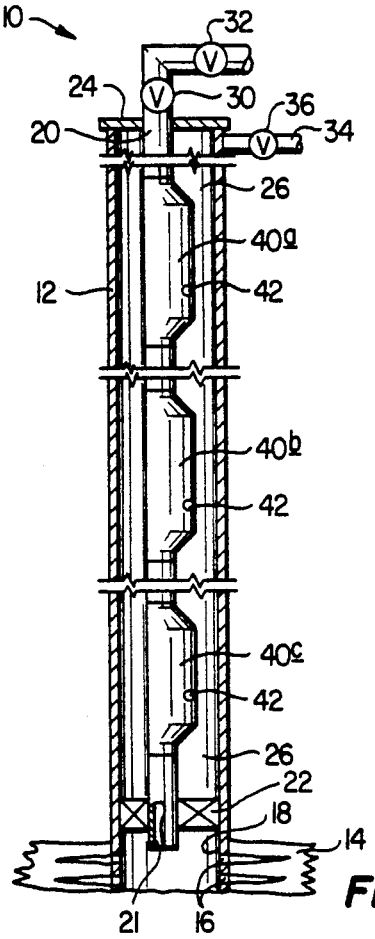
FIG. 1 is a schematical view of a gas lift well having a plurality of side pocket mandrels connected into and forming a part of the well tubing.

Referring now to FIG. 1 of the drawing it is seen that a system for producing a well is schematically illustrated. The well, identified by reference numeral 10 as shown is a gas lift well. It has a casing 12 penetrating an earth formation 14 which in this case represents an oil bearing zone. Perforations 16 provide passages for the movement of oil from formation 14 into the bore 18 of casing 12. A string of well tubing 20 having a bore 21 is disposed in the casing with its lower end at or near the perforations 16. A well packer 22 seals between the exterior of the well tubing 20 and the inner wall of casing bore 18 at a location just above the perforations. A wellhead 24 seals the upper end of the casing about the well tubing. Thus, the tubing-casing annulus 26 is closed at its upper end by the wellhead 24 and at its lower end by the packer 22. Production fluids entering the casing via the perforations cannot flow upward through the annulus because of the packer but are free to flow upwardly to the surface through bore 21 of the well tubing. A master valve 30 and a wing valve 32 control flow from or into the well tubing. A lift gas conduit 34 including a valve 36 is connected into the upper end of the casing 12 just below the wellhead 24 for controlling flow of lift gas into or from the annulus 26.

Figure 2:
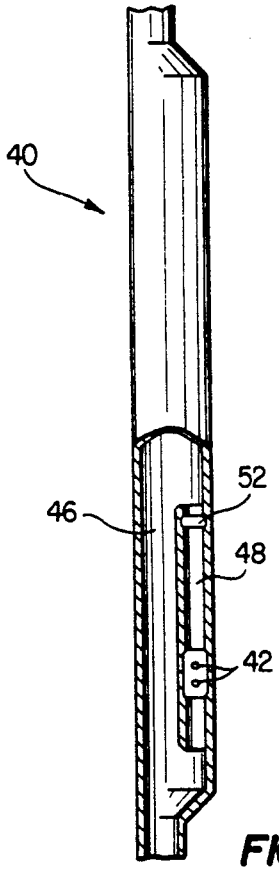
FIG. 2 is a longitudinal partly sectional view of a side pocket mandrel such as is shown in FIG. 1.

The well tubing 20, as shown includes a plurality of special sections known as side pocket mandrels and are identified by reference numerals 40*a*, 40*b*, and 40*c*, each having an inlet port 42. Each of the side pocket mandrels, with the exception of the lowermost (40*c*) contains a gas lift valve or more specifically an unloading valve of this invention for controlling flow of lift gas through its inlet port 42 and into the tubing to aid in lifting well liquids therethrough to the surface. A side pocket mandrel like those identified by the reference numerals 40*a*, 40*b*, and 40*c* is schematically illustrated in FIG. 2 where it is identified by the reference numeral 40.

Side pocket mandrel 40 would be provided with threads (not shown) at its opposite ends for attachment in a string of well tubing to constitute a portion thereof. The mandrel 40 has a main bore 46 axially alignable with that of the well tubing and has an offset receptacle 48 adapted to receive a gas lift valve (not shown). Such gas lift valve would be provided with seal means for sealing above and below the inlet port means 42 and locking means (not shown) for securely anchoring the gas lift valve in operating position in the receptacle for controlling flow through the inlet port means, the anchoring means having locking means engageable in lock recess means such as lock recess 52. The gas lift valve is readily installed in the side pocket mandrel or removed therefrom in a well-known manner through use of wireline equipment and techniques, and since the receptacles are offset in the side pocket mandrels, as shown, there is random access to the gas lift valve in any one of the side pocket mandrels.

Referring now to FIGS. 3A through 5, the preferred embodiment of the gas lift device, indicated by the reference numeral 100, of this invention will be described.

Figure 3A:
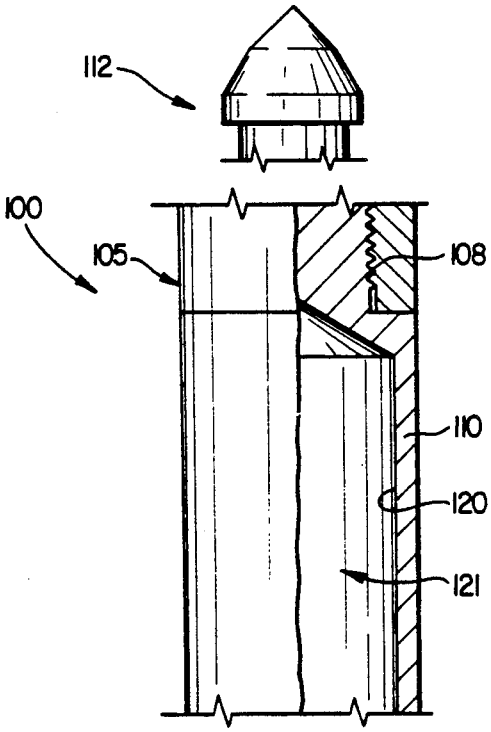
FIGS. 3A, 3B, and 3C, taken together, constitute a longitudinal view, partly in section and partly in elevation, with some parts thereof broken away showing a gas lift valve structured in accordance with the present invention and showing both the pilot valve and the main valve open.
Figure 4A:
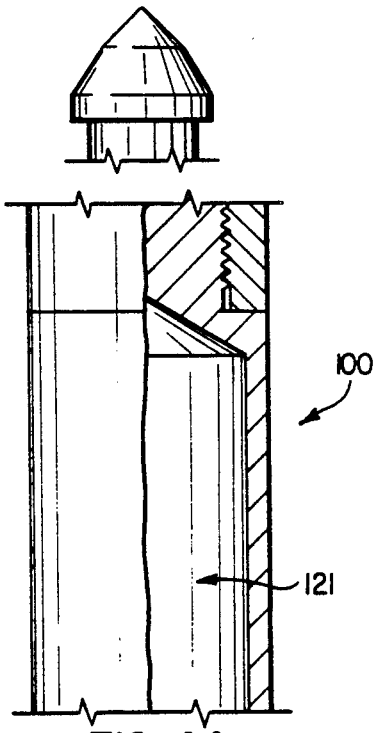
FIGS. 4A, 4B, and 4C are views, similar to those of FIGS. 3A, 3B, and 3C, showing the gas lift valve thereof with its pilot valve and main valve closed.

In FIG. 3A, the unloading valve 100 is seen to be provided with latch mean 105 attached as by threads 108 to the upper end of body means 102 which includes upper body member 110, as well as other body sections therebelow for housing pilot valve means, main valve means, and check valve means to be described shortly. Latch means 105 may be of any suitable type and may include a fishing neck at its upper end as at 112 and lock means (not shown). This latch means serves to secure the device in a downhole receptacle such as the offset receptacle 48 of the side pocket mandrel 40.

The upper body member 110 is provided with a blind bore 120 which is closed at its upper end and open at its lower end where it is internally threaded as at 122 for attachment to the upper threaded end of upper pilot housing section 130 of pilot valve means 125. Seal ring 123 seals this connection. The blind bore 120 constitutes the greater part of a liquid chamber 121 which is to contain a compressible liquid to be identified later.

The pilot valve means 125 of the unloading valve 100 has its upper pilot housing section 130 and its lower pilot housing section 13 threadedly connected together as at 134. The lower end of the lower pilot housing section 132 is internally threaded as at 136 and is screwed to the upper end of main valve body section 138. This connection is sealed by a suitable seal ring such as o-ring 137. Main valve body section 138 is provided with inlet ports 139 for admitting fluids thereinto from the exterior when main valve 140 is in open position. The main valve body section 138 is reduced as at 141 to receive the packing set **186*a* which will seal with the side pocket mandrel 40 below the inlets 42 when the device 100 is installed therein. The lower end of main valve body section 138 is externally threaded as at 142 for attachment of the nose 150 which forms the lower end portion of the body means 102 of unloading valve 100. A seat ring 151 of a suitable resilient material such as RYTON is interposed between the lower end face 138*a* of the main valve body section and the upwardly facing shoulder 150*a* of the nose, as shown, to be sealingly engaged by the check valve member 160. The check valve 160** is movable between an open position, seen in FIG. 3C, and a closed position, seen in FIG. 4C.

Nose 150 is rounded and tapered toward its lower end, as at 152 for guiding the unloading valve past shoulders, coupling recesses, and the like, as it is lowered through the well tubing with wireline and tools, and also to provide ample passage for the downward flow of fluids as they exit the lower end of the unloading valve 100. The nose is formed with a bore 153 which is reduced and becomes square at 154 (see FIG. 5) and is further reduced and becomes round at 155. A window 156 (four are obvious in the device illustrated) is formed through the wall of the nose to provide an outlet for fluids exiting therefrom, as mentioned above. The check valve 160 having a large head 162 is slidable in bore 153 and its square shank 163 is slidable in square bore portion 154. The purpose of the check valve is to prevent the flow of fluids from the tubing to the annulus.

The main valve 140 of the device controls the flow of fluids from the annulus 26 into the bore of the well tubing string 20. The pilot valve means 125 controls opening and closing of the main valve in response to changes in pressure in the annulus 26 in a manner to be made clear later.

Figure 3B:
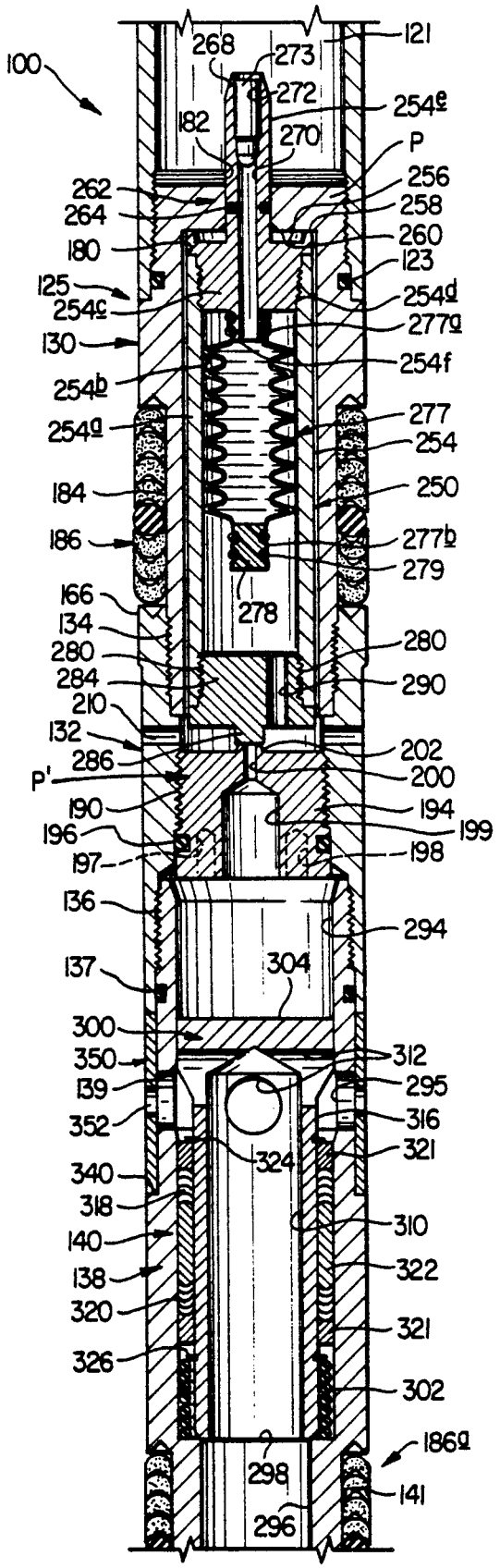

Continuing now with the structural details, it is seen in FIG. 3B, that the upper pilot housing section 130 of the pilot valve means 125 is formed with a bore 180 which is greatly reduced at its upper end as at 182. It is seen that the almost closed upper end of the upper pilot housing section 130 forms an upper partition P in the device 100. The outside diameter of the upper pilot housing section is reduced as at 184 a spaced distance below the o-ring 123 to adapt this section to carry the packing set 186 whose purpose it is to sealingly engage and seal bidirectionally with the bore 48 of the offset receptacle of the side pocket mandrel at a location above the inlet ports 42 of the mandrel.

The lower pilot housing section 132 of the pilot valve means, has its upper portion slightly enlarged as at 166 to better back up the packing set 186. Not only is this lower pilot housing section 132 provided with threads 134 for attachment of the mating upper pilot housing section and threads 136 for attachment to power section 140, but it is further provided with an internal thread therebetween as at 190, for securing therein a partition in the form of pilot seat member 194 as shown. O-ring 196 seals this thread against leakage of fluids. It is seen that pilot seat member 194 constitutes a lower partition P' in the device 100. Pilot seat 194 is provided with a pair of downwardly opening blind holes as at 197 and 198 for engagement of a special wrench with which the thread 190 is adjusted. The seat 194 is formed with a central bore 199 which is greatly reduced as at 200 to form a small passage of predetermined size. A narrow seat surface 202 is formed about the upper end of passage 200. At least one lateral passage 210 is formed through the wall of the lower housing section 132 above seat member 194 to admit fluid pressure into the pilot valve means for a purpose soon to be made clear.

Pilot valve piston means 250 is slidably carried in the bore 180 of the upper pilot housing section 130. Its longitudinal movement within the housing is limited to only about 0.020 to 0.030 inch (about 0.5 to 0.75 millimeter).

The body 254 of the pilot valve piston means 250 has an outer cylindrical surface only slightly smaller than the bore 180 of the upper housing section so that it will be readily slidable yet remain adequately aligned therein. The upper end of the pilot valve body is reduced to provide an upwardly facing shoulder formed with an annular recess 256 having an upstanding rim as at 258. This recess provides room for solid particles to move thereinto which otherwise may lodge between the rim 258 and the downwardly facing shoulder 260 of partition P which, limits its upward movement, and which the rim must contact fully if it is to make its full stroke. The pilot seat 194 is screwed upward until the rim 258 of pilot valve 250 engages the lower side of the upper partition P and the pilot valve tip is seated on seat 200. The seat 194 is then unscrewed slightly to provide the required stroke for the pilot valve. Of course, this adjustment of the pilot seat 194 must be preserved. A good way of doing this is to apply a bonding agent to the thread and then make and adjustment before the bonding agent sets. A very suitable bonding agent is marketed widely under the name of LOCTITE. The medium-strength type which bonds but does not necessarily seal is recommended. A few drops placed on the leading thread is all that is needed, and it will allow about 5 to 10 minutes before it bonds. Suitable sealing agents particularly of the sealing and securing type should be used on all other threads of these gas lift valves. The reduced upper end portion of the pilot valve body provides a piston 262 formed with an annular recess in which a seal ring such as o-ring 264 is carried. This piston and o-ring are slidable in reduced bore 182 in the partition P. Since the stroke thereof is very short, the groove in which the seal ring 264 is carried is necessarily only sufficiently wide to receive the seal ring. Thus, rolling of the seal ring is avoided and the piston 262 and seal ring 264 move substantially in unison. The effective area of this piston equals the area sealed by the seal ring 264 minus the area of the small bore 200 when the pilot is closed. When the pilot valve is open, the effective area of this piston is equal to the full area of the piston. The end of the piston is suitably chamfered as at 268.

Pilot valve body 254 includes a barrel **254*a* having a bore 254*b*, the barrel having a piston body 254*c* secured in the upper end thereof as by thread 254*d*. The piston body is formed not only with reduced diameter projection 254*e* extending from its upper end, which projection constitutes the heart of piston 262, but is also formed with reduced diameter projection 254*f* extending from its lower end. A small central bore 270 extends through the upper projection 254*e* and lower projection 254*f* as shown. The lower projection then forms a nipple over which the upper end of bellows 277 is telescoped where it is retained thus engaged by suitable retaining means. In the device shown, a pair of o-rings 277*a*** were found to retain the bellows satisfactorily.

The upper portion of bore 270 is suitably prepared as at 272 to receive a suitable flow restrictor 273, as shown. Preparation of the bore 270 and installation of the flow restrictor is to be as specified by the manufacturer of the flow restrictor. The flow restrictor 273 preferably includes a filter for excluding solid particles from entering the chamber 121. Suitable flow restrictors with filters are available from various suppliers, for instance, from the Lee Company, Westbrook, Conn. 06498-0424. The main portion of the bellows 277 is located in this large bore **254*b*. The bellows is preferably formed of a pliable elastomeric material. The flow restrictor provides restricted communication between the liquid chamber 121 and the interior of bellows 277. The larger cuff 277*b* at the free end of the bellows is plugged with a plug 278 made of a suitable material such as Delrin. The plug is formed with at least one, but preferably two external grooves and after the plug has been positioned in the free end of the bellows an o-ring 279** is placed about the cuff and seated in each groove of the plug, as shown, to retain the plug in this sealing position.

It is important that the compressible liquid fill the liquid chamber including that portion of bore 270 which leads to the bellows 277, and it is imperative that the bellows be filled completely when at its free length and at atmospheric pressure and at room temperature. This will allow for expansion and contraction of the liquid in chamber 121 as a result of changes in temperature and in pressure. The bore of barrel **254*a* is threaded as at 280 for attachment of the pilot valve tip member 284 as shown. Pilot valve tip member is formed with a valve tip 286 for engagement with seat surface 202 on seat member 194 for closing passage 200, and this tip is preferably provided with a relatively thin layer of a suitable elastomeric material such as NITRILE cemented or bonded in place thereon by a suitable agent such as EPOXY. The pilot valve tip member is provided with a fluid passage such as that at 290 for admitting fluid pressure into the bore 254*b* of the pilot valve barrel where it will apply compressive forces to the entire exterior surface of the bellows 277 and will thus transmit its pressure to the compressible liquid in the liquid chamber 121 through the flow restrictor 273**.

The bore 199 of the pilot valve seat 194 opens into the bore 294 of the main valve body section 138. The bore 294 is provided with an internal annular recess 295 which provides a pair of annular guide surfaces straddling inlet ports 139 for preventing damage to sliding seal means yet to be described. Bore 294 is reduced as at 296 to provide an upwardly facing shoulder 298 for limiting downward movement of main valve member 300 and for supporting spring 302 which biases main valve member 300 upwardly. Upward movement of main valve member 300 is limited by engagement of its upper end 304 with the lower end of the pilot valve seat 194.

The upper end 304 of the main valve member is a close but free sliding fit in bore 294 but does not sealingly engage its wall because slight leakage at this location is necessary since the upper end surface 304 of the main valve member is a pressure responsive surface and must respond only when the pilot valve demands it to do so, as will be seen.

The main valve member is formed with a blind bore 310 which opens downwardly into reduced bore 296 of the main valve body section 138. Main valve member 300 is provided with flow openings 312 just below its closed upper end. Near the location of such flow openings, the outside diameter of the main valve body is reduced as at 316 and two sets of opposed and spaced apart packing rings 318 and 320 with suitable adapters 321 and 322 are mounted thereon between retaining rings 324 and 326 which are engaged in suitable annular recesses formed in the exterior of the main valve member 300 as shown. Thus, the packing rings 318 and 320 are carried by the main valve member and move up and down therewith as it moves between its upper position seen in FIG. 4B and its lower position seen in FIG. 3B.

When the main valve member is in its upper position, seen in FIG. 4B, the seal rings 318 and 320 seal above and below the inlet ports 139 in the main valve body and no flow can take place therethrough. However, when the main valve member is in its lower position, seen in FIG. 3B, the flow ports 312 of the main valve member are in direct communication with the inlet ports 139 of the main valve body and fluids may readily enter therethrough and flow downwardly through bore 310 of the main valve member, bore 296 of the main valve body section 138, past the check valve 160 and out through the windows 156 at the lower end of the device 100.

It is recommended that the main valve body 138 be reduced in outside diameter from the thread 136 at its upper end down to a spaced distance below the inlet ports 139 of the main valve body section, to provide an abrupt upwardly facing shoulder 340 and that a ported sleeve such as ported sleeve 350 having ports such as ports 352 be placed about main valve body 138 as shown and supported upon the shoulder 340. When the thread 136 is made tight, the sleeve 350 will be gripped between the lower end of the lower pilot valve housing 132 and the shoulder 340 and will be secured against rotation. The sleeve 350 can be oriented as desired to selectively partially cover the inlet openings 139 and control the flow capacity thereof. For convenience, suitable index markings may be placed as at 313 on the exterior surface of the ported sleeve and on the exterior surface of the main valve body section to aid in adjustment of the orientation of sleeve 350. Tightening of thread 136 after such adjustment will preserve the set orientation. Hole sizes and patterns thereof may be provided in the sleeve as desired.

When the device 100 is in place in a side pocket mandrel such as that indicated in FIG. 1 by reference numeral 40*a*, 40*b*, or 40*c* of well 10 and lift gas is injected into the casing through conduit 34 and valve 36. Pressurized fluid in the casing will pass through ports 42 of the side pocket mandrel and will enter lateral aperture 210 of lower pilot housing 132, will pass through passage 290, act upon the exterior surface of bellows 277 and will therefore transmit casing pressure to the liquid in bellows 277. Pressurized fluid also passes through ports 352 and 139 but can go no further since the main valve is as yet closed, as seen in FIG. 4B. As the bellows is compressed, the liquid contained in the bellows is also compressed. It should be understood, then, that casing pressure acts upon the exterior of the bellows all the while that the device 100 is in the side pocket mandrel in the well. As the bellows is compressed liquid is transferred from the bellows into the liquid chamber 121. This transfer of liquid must take place through the flow restrictor 273 which has a very small flow capacity. Restricting the flow results in a drop in pressure which creates a force tending to move the pilot valve member toward its open position. If for some reason it was closed, the increase in casing pressure as a result of injecting lift gas will cause the pilot valve to open. Thus, when the pilot valve is open, casing pressure is admitted through the passage 200 of pilot valve seat 194. Casing pressure thus acts against pressure responsive surface 304 of main valve member 300 and forces this member to its open position (FIG. 3B), compressing spring 302. Fluids from the casing may now flow through ports 352, inlet openings 139 and main valve ports 312 to the interior of the main valve member and then flow downwardly through the main valve bore 310, body bore 296, past the check valve 160 and exit through windows 156.

When the casing pressure is reduced significantly in a short, but not too short, period of time, the liquid in the liquid chamber 121 will be at a greater pressure than the casing pressure and will cause the pilot valve member to be moved to its closed position wherein its tip 286 seats upon seat surface 202 and closes the passage 200.

Figure 4B:
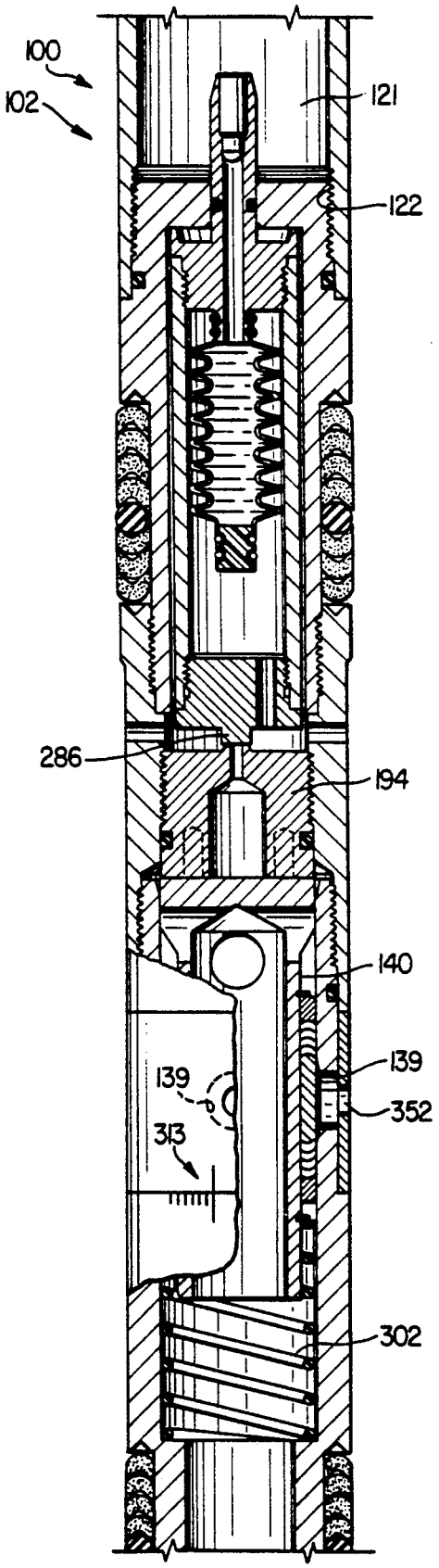
Figure 3C:
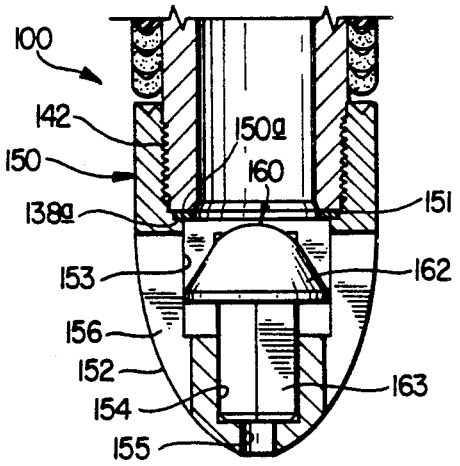
Figure 4C:
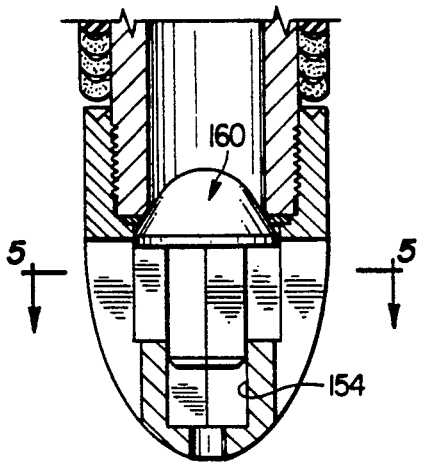
Figure 5:
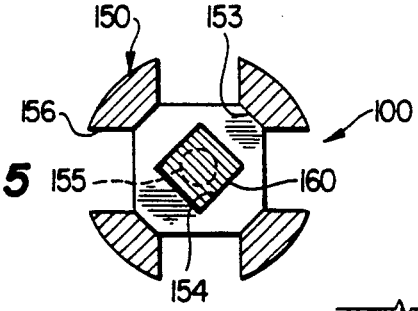
FIG. 5 is a cross-sectional view taken along line 5—5 of FIG. 4C.

Upon closing of the pilot valve, tubing pressure which exists in bore 310 of the main valve equalizes across the closed upper end of the main valve, since it does not seal with the bore of the main valve housing 138, and the spring 302 returns the main valve to its closed position seen in FIG. 4B. This closing of the main valve stops the flow of fluids into the tubing from the annulus. The volume of the liquid in the chamber, the compressibility of that liquid, the diameter of the piston, and the length of piston's stroke are all interrelated, as seen in the following equation:

$$\frac{\pi}{4} D^2 \Delta s = \frac{\Delta P \, V_o}{B}$$

where:

$D_p$=Diameter of piston $\Delta s$=Travel of piston, 0.02–0.03 in. (0.5–0.75 millimeter)

$\Delta P$=Pressure change acting upon the bellows $V_o$=Original volume of the liquid chamber B=Bulk modulus of the liquid (for Dow Corning 200 Silicone liquid, $B=1.6\times10^5$)

It is desirable to provide a piston travel of approximately 0.025 inch (0.635 millimeter) for a 20 psi (137.90 kilopascal) change in the pressure acting upon the exterior surface of the bellows. It is further desirable to provide a piston having a cross-sectional area which is approximately ten times the cross-sectional area of the pilot port 199 which is closed by pilot valve tip 286.

The rate of liquid transfer between the bellows and the liquid chamber will govern the sensitivity of the response of the pilot to such change in pressure acting upon the exterior surface of the bellows. The rate of liquid transfer between the bellows and the liquid chamber is dependent upon the viscosity of the liquid and the flow capacity of the flow restrictor between the bellows and the liquid chamber. A high degree of sensitivity can be obtained, for instance, by using a liquid having a viscosity of approximately 1,000 centistokes in combination with a restrictor providing a flow resistance of about 35,000 lohms. (The term "LOHM" is a term originated by The Lee Company, supra, which coined it from the words "liquid" and "ohm". It is related to liquid flow in a manner similar to the way in which the term "ohm" is related to the flow of electrical current.

Figure 6:
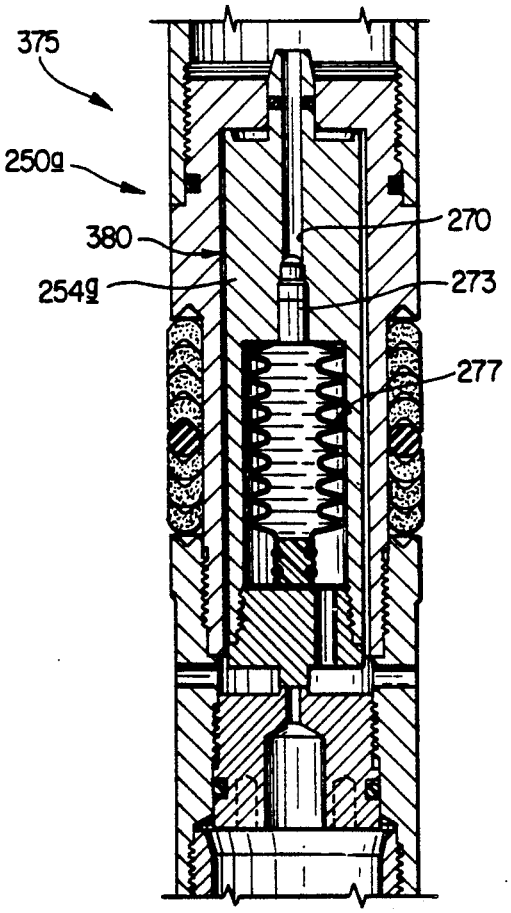
FIG. 6 is a fragmentary longitudinal sectional view showing a modified form of pilot valve.

Referring now to FIG. 6, it is seen in this fragmentary view that a modified form of unloading valve is indicated by the reference numeral 375 and that the modification lies in the pilot valve 250*a* thereof. In this embodiment the pilot valve body 254*g* has no nipple about the lower end portion of bore 270, and the flow restrictor 273 is placed in the lower portion of bore 270 rather than at its upper end. In addition, the upper end of the bellows 277 is anchored in the lower end of bore 270 by suitable means such as by the flow restrictor 273 or as by a bonding agent (not shown), or the like. The unloading valve 375 functions in the same manner as does the unloading valve 100 previously described.

Figure 7:
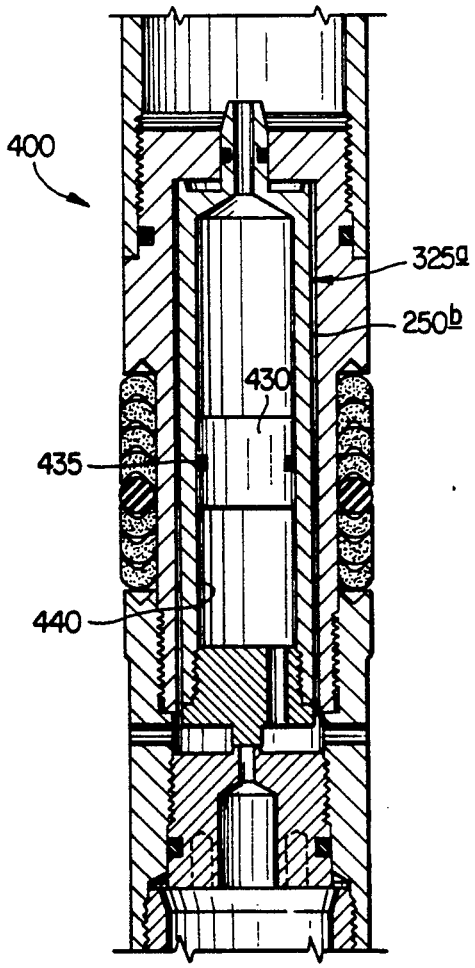
FIG. 7 is a fragmentary longitudinal sectional view showing another modified form of pilot valve.

Referring now to FIG. 7, it will be seen that the device illustrated is identified by the reference numeral 400. This device is almost identical to device 100 just described with the exception of the modified pilot valve member 250*b* and the means therein for separating the compressible liquid from the casing fluids. Instead of being provided with a flow restrictor and separator means in the form of a bellows as in device 100, the pilot valve member 250*b* of device 400 is provided with separator means in the form of a sliding partition or piston 430 having a seal ring for sealing therearound such as o-ring 435 carried in a suitable annular recess. This piston 430 is slidable in bore 440 of the pilot valve member 250b in response to changes in pressure and temperature conditions. Of course, a differential pressure acting across the piston and seal ring tends to move the pilot valve member 250b between its open an closed positions because of the drag, or stiction, of the seal ring against the wall of bore 340.

Figure 8:
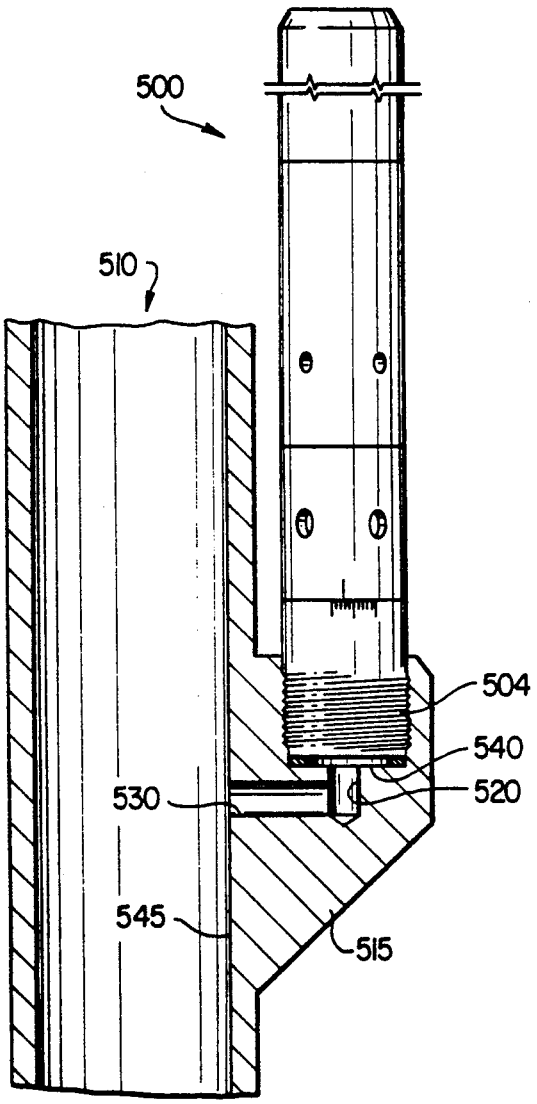
FIG. 8 is a fragmentary schematical view partly in longitudinal section showing a gas lift valve of this invention mounted on the exterior of a well tubing.

Referring to FIG. 8, it is seen that a device 500 is attached as by threads 504 to a gas lift mandrel 510 of the type having an external mount. The mount includes a boss 515 having a vertical passage way such as at 520 which is enlarged at its upper end and threaded as at 504. A horizontal passage 530 intersects or connects with vertical passage 520 to constitute a continuous passage communicating the outlet 540 of the device 500 with the bore 545 of the mandrel 510. Mandrel 510 would be provided with means such as threads on its upper and lower ends for attachment of the mandrel in a string of well tubing in the conventional manner.

The workings of device 500 are almost exactly like the device 100, 375, or 400 with the exception that it has no thread at its upper end since no latch means, such as latch means 105, is needed, and the lower end of the device has no nose but is instead adapted with thread 504 for attachment to mandrel 510. Of course, a more conventional type of check valve must be used in place of check valve 160. The device 500 will control the entry of gas into the well tubing from the casing in the same manner as described with respect to devices 100, 375, and 400.

It should be noted that, since the valve 500 is mounted on the exterior of the tubing, it cannot be retrieved or replaced with wireline tools. Instead, the device 500 can only be retrieved by retrieving the well tubing.

Figure 9:
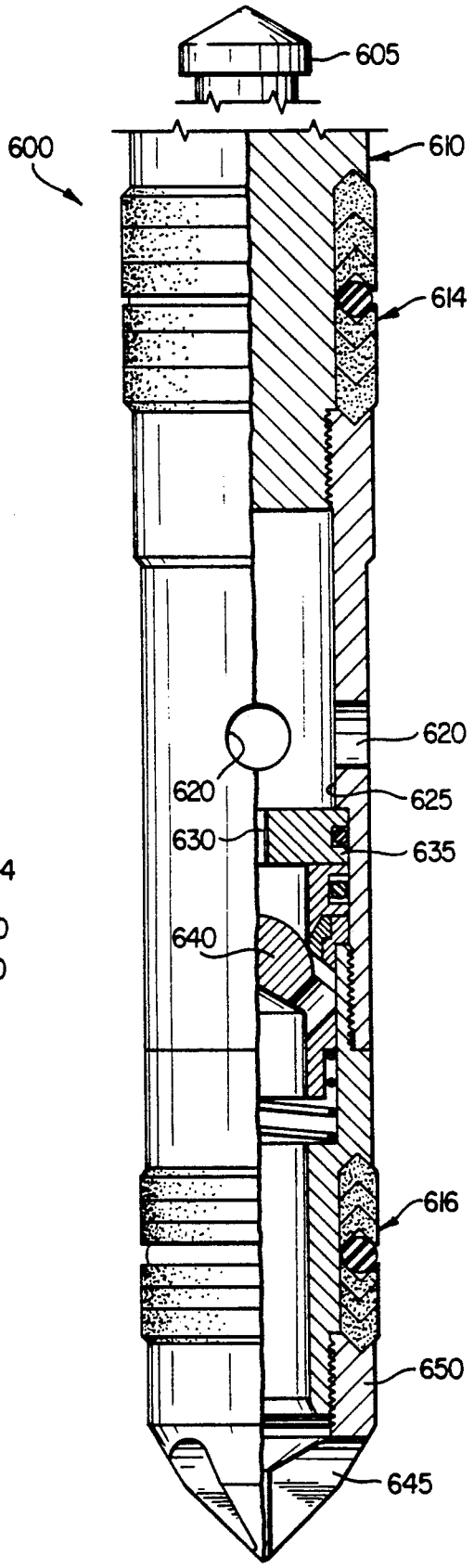
FIG. 9 (PRIOR ART)
FIG. 9 is a longitudinal view, partly in elevation and partly in section showing an orifice valve for use below the plurality of unloading valves in a well.

Referring to FIG. 9, it is seen that an orifice valve for use in a side pocket mandrel such as that indicated by the reference numeral 40c is illustrated. This orifice valve is indicated generally by the reference numeral 600. Such device is known as a circulation valve or a gas lift valve and is useful as an operating valve in a manner described below. Such valves are available from Otis Engineering Corporation, Box 819052, Dallas, Tex. 75381-9052.

Device 600 is provided with latch means as at 605 for anchoring the device in the offset receptacle of a side pocket mandrel and, in a gas lift well, would occupy the next lowest side pocket mandrel below the lowest unloading valve. Thus, the device 600 if used in the well 10 would be installed in side pocket mandrel 40c. The device 600 is further provided with a body 610 having upper and lower packing sets 614 and 616 for sealing above and below the inlet 42 of side pocket mandrel 40c. Fluids flowing through the inlet 42 of the side pocket mandrel may pass through the ports 620, flow downwardly through bore 625, through restricted opening 630 of choke 635, past check valve 640 and exit through windows 645 in the nose 650. The check valve obviously permits fluid flow from casing to tubing but will not allow flow from tubing to casing.

Device 600 simply provides an orifice or choke for metering the flow of lift gas entering the tubing and a check valve for preventing tubing contents from flowing into the casing.

Placing a well such as well 10 on gas lift operating would entail installing the tubing with its open lower end near the perforations and having a packer sealing between the tubing and the casing above the perforations. The side pocket mandrel 40c would be placed at the proper depth in the well for single point injection of lift gas. A device such as device 100 would occupy each of the side pocket mandrels, say 40a and 40b, thereabove which would be located at depths determined by good gas lift practices. If desired, all of the side pocket mandrels may be run with a dummy valve therein for protecting the offset receptacle. Afterwards, these dummy devices could be retrieved and the unloading valves 100 and the orifice valve 600 installed.

The well 10, at the time of running these devices 100 and 600 would likely be full or mostly full of liquid (oil, water, or the like), and this liquid must be unloaded from the tubing bore 21 and the annulus 26 down to the orifice valve 600 before gas can be injected into the tubing at that level.

To unload the well, the tubing is opened at the surface by opening master valve 30 and wing valve 32. The flow line may lead to a burning pit or other facility for handling the large volume of liquid which will be removed from the well.

All of the devices 100 (or the devices 375 or 400, should they be used) will initially have their main valves closed and their pilot valves likely will be open. The valve 36 on the lift gas supply line 34 is opened and lift gas at a pressure, for instance, of about 700–800 psi (4826–5516 kilopascals) is injected into the annulus 26. This increases the pressure in the annulus appreciably and causes the main valves of the unloading valves 100 to open. This gas pressure on top of the liquid in the annulus will result in the column of liquid in the annulus being depressed and liquid to rise in the tubing as the liquid transfers through the open valves into the tubing. Liquid will begin to flow from the tubing through valves 30, 32 and will issue from the flow line at the burning pit or other point of disposal.

Gas injection should be carefully controlled at a rate equal to about 150 percent of that quantity which will transfer through one of the unloading valves. When the liquid level in the annulus drops below the ports 42 of the side pocket mandrel 40a, gas will commence entering the tubing bore at that level, the unloading valve therein being open. This gas will aerate the column of liquid in the tubing, thus reducing its density considerably. As a consequence, the velocity of fluids flowing through the tubing increases, as does the surface pressure on the tubing.

When the liquid level in the annulus reaches the side pocket mandrel 40b and gas begins to transfer to the tubing through the unloading valve 100 contained therein, the transfer of gas from the casing to the tubing is doubled for it is now being transferred through two devices 100 instead of one.

This doubling of the flow rate of gas from the casing to the tubing reduces the casing pressure, and since the casing pressure acts continuously upon the liquid in the bellows 277 of the unloading valve in side pocket mandrel 40a, the pressure of such liquid, also, is decreased. This change creates a differential pressure across the cross-sectional area of the bore sealed by o-ring 264 on the probe 262, the higher pressure being in the liquid above this seal and the reduced casing pressure being in the bore 180 of the upper pilot valve housing surrounding the pilot valve member. Since the differential acting there across is delayed due to the flow restrictor 275, the differential pressure across the flow restrictor will move the pilot valve member from its open position, seen in FIG. 3B to its closed position seen in FIG. 4B.

Now, with gas being transferred through but a single device 100, the casing pressure will return to normal and unloading will continue. The just-closed unloading valve will not reopen in response to this increased casing pressure due to the increased differential pressure acting across port 200 to hold the pilot valve shut. The column of liquid in the annulus will continue to drop until another side pocket mandrel is uncovered. The cycle just described will be repeated until the liquid level is depressed to the side pocket mandrel containing the device 600. Of course, when the device 600 is uncovered, the pressure in the casing is decreased because gas continues to transfer from the casing to the tubing through the device 100 in the side pocket mandrel next above it. This decrease in casing pressure causes the device 100 to close as before explained, leaving the gas to be injected at a single point—the device 600.

Thus, the liquid has been unloaded from the well automatically, it being only necessary to maintain a reasonably constant injection rate, at about 150 percent of the transfer capacity of one of the devices 100, to cause the closing of each one of the devices 100 in turn soon after the device next below it begins to transfer gas into the tubing.

Subsequently, the injection pressure and rate are adjusted in accordance with gas lift principles so that gas lifting of well fluids will continue in the conventional manner.

Thus, it has been shown that unloading valves 100, 375 and 400 have been disclosed, which fulfill all of the objects drawn thereto and set forth early in this application. In each o these embodiments of the present invention casing pressure acts upon a predetermined volume of compressible liquid either to compress it, or to permit it to expand. Each such device includes a pilot valve which senses such volumetric changes and reacts thereto to effect opening and closing of the main valve to control transfer of lift gas from the casing into the tubing, or to prohibit the same.

Further, it has been shown that gas lift systems have been disclosed which utilize unloading valves, such as unloading valves 100, 375, or 400. Also, methods of operating gas lift systems through use of such unloading valves are disclosed.

The foregoing description and drawing of the unloading valves as well as the systems and methods are explanatory and illustrative only and changes in sizes, shapes, materials, and arrangements of parts as well as certain details of construction may be made within the scope of the appended claims without departing from the true spirit of this invention.

I claim:

1. A gas lift device for controlling the flow of gas between the exterior and the interior of a well tubing, comprising:

(a) body means, said body means having inlet means, an outlet, a flow course extending between said inlet means and said outlet, means on said body for attachment to means for securing the same to said well tubing;

(b) main valve means, including:

(i) a main valve member in said body slidable between an open position wherein flow is allowed to take place through said flow course and a closed position wherein such flow is prohibited, (ii) means biasing said main valve member toward closed position, and (iii) a pressure responsive area on said main valve member for moving said main valve member toward open position in response to pressure exterior of the tubing acting thereon;

(c) a main chamber in said body means for containing a volume of compressible liquid;

(d) pilot valve means in said body means between said main chamber and said main valve means, said pilot valve means including a variable volume chamber for containing a compressible liquid, a restricted fluid passage for fluidly communicating said variable volume chamber with said main chamber, and pressure responsive means for moving said pilot valve means from a closed position to an open position responsive to a differential pressure across said pressure responsive means as a result of an increase in pressure exterior of said well tubing for controlling admission of fluid pressure from said exterior of said tubing to said pressure responsive area of said main valve member for moving the same to open position; and (e) means for sealing between said main valve and said body.

2. The device of claim 1, wherein said means for sealing between said main valve and said body is seals carried on said valve, said inlet means includes a ported sleeve rotatably disposed about said body and the orientation of the sleeve upon the body provides adjustment of the flow capacity of said inlet means, and said device further includes:

(a) separator means for separating said compressible liquid from well fluids, said separator means being pliable whereby the pressure of fluids contacting said separator means is readily transmitted through said separator means to said compressible liquid; and (b) check valve means for prohibiting reverse flow through said outlet.

3. The device of claim 2, wherein said ported sleeve and said body are provided with index markings for indicating the orientation of said sleeve upon said body, means is provided for securing the selected orientation, and said check valve means includes:

(a) check valve seat means, including a resilient seat ring, surrounding said flow course; and (b) a check valve member in said body movable between an open position wherein flow is permitted through said outlet, and a closed position in which said check valve member is engaged with said check valve seat means and closes said flow course to prohibit flow in a reverse direction.

4. The device of claim 3, wherein said body means includes a first partition for limiting upward travel of said main valve member, said first partition having an opening therethrough, a second partition spaced from said first partition to provide a pilot valve chamber between them, said second partition also having an opening therethrough, and said housing is provided with a lateral opening communicating said pilot valve chamber with the exterior of said body, and a pilot valve member slidably carried in said pilot valve chamber, said pilot valve member including:

(a) a hollow pilot valve body having a small diameter probe at one end slidably disposed in said central opening of said second partition and having a small bore therethrough communicating the liquid chamber with the interior of said hollow;

(b) means sealing between the exterior of said probe and the wall of said opening in said second partition;

(c) a projection on the end of said pilot valve body opposite said probe and having a seal surface thereon for closing said opening through said first partition when said pilot valve is in closed position;

(d) a resilient material on said seal surface of said projection for sealingly engaging across said central opening of said first partition;

(e) said small bore in said probe is enlarged as it nears said hollow and a replaceable flow restrictor is deposited therein for creating a differential pressure thereacross to generate a force for moving said pilot valve body to open position;

(f) said separator constitutes a bellows formed of a non-porous pliable material and having one end thereof closed and the other end thereof sealingly engaged in said small bore in said probe, said bellows being filled with said compressible liquid;

(g) a passage in the wall of said pilot valve body for admitting annulus fluids thereinto to contact said bellows for transmitting pressures thereof to said compressible liquid;

(h) whereby when the pressure of fluids admitted into the pilot valve chamber increases, the bellows will be compressed and liquid therein will be forced through said flow restrictor creating a differential pressure thereacross and as a result thereof create a force tending to move the pilot valve member toward the liquid chamber to thus open the central opening in the first partition which admits fluids from the exterior of the tubing into the main valve section to act upon the pressure responsive area of the main valve to move it to open position to permit flow through said flow course.

5. The device of claim 4, wherein said bellows is formed of an elastomeric material and said resilient material on said seal surface of said projection of said pilot valve is Nitrile.

6. The device of claim 3, wherein said body means includes a first partition for limiting upward travel of said main valve member, said first partition having an opening therethrough, a second partition spaced from said first partition to provide a pilot valve chamber between them, said second partition also having an opening therethrough, and said housing is provided with a lateral opening communicating said pilot valve chamber with the exterior of said body, and a pilot valve member slidably carried in said pilot valve chamber, said pilot valve member including:

(a) a hollow pilot valve body having a small diameter probe at one end slidably disposed in said central opening of said second partition and having a small bore therethrough communicating the liquid chamber with the interior of said hollow;

(b) means sealing between the exterior of said probe and the wall of said opening in said second partition;

(c) a projection on the end of said pilot valve body opposite said probe and having a seal surface thereon for closing said central opening through said first partition when said pilot valve is in closed position;

(d) a resilient material on said seal surface of said projection for sealingly engaging said across said central opening of said first partition;

(e) a floating piston sealingly bridging said hollow of said pilot valve body for separating said compressible liquid from fluids in the well casing, and (f) a passage in the wall of said pilot valve body for admitting well fluids thereinto to contact said piston on the side thereof opposite said compressible liquid, (g) whereby when the pressure of fluids admitted into the pilot valve chamber increases, the increased force thereof tends to move the piston in a direction to compress the compressible liquid, the drag of the piston tends to move the pilot valve member toward the liquid chamber, thus, tending to open the central opening in the first partition which admits fluids from the casing into the main valve section to act upon the pressure responsive area of the main valve and move it to open position to permit flow through said flow course.

7. The device of claim 6, wherein said resilient material secured to said flat surface of said pilot valve body is Nitrile, and the area surrounding the opening through said first partition is raised to more efficiently seal with said flat surface and the Nitrile material secured thereto and a ridge is formed on said pilot valve body surrounding said probe for engaging said second partition for limiting movement of said pilot valve body and forming an annular recess between said ridge and said probe to provide space for sand or other solids to move in the stead thereof to permit the ridge to fully engage said second partition.

8. The device of 1, 2, 3, 4, 5, 6, or 7, wherein said compressible liquid is silicone liquid.

9. The device of claim 2, 3, 4, 5, 6, or 7, wherein said ported sleeve for adjusting the flow capacity of said inlet means of said body has been ion nitride coated.

10. The device of claim 1, 2, 3, 4, 5, 6, or 7, wherein the device further includes a latch for releasably anchoring the device in a landing receptacle.

11. The device of claim 1, 2, 3, 4, 5, 6, or 7, wherein the device is adapted for mounting on the exterior of a well tubing through use of gas lift mandrel having an external mount.

12. A well installation for carrying out gas lift operations, comprising:

(a) a well casing extending from the surface to a subsurface production zone and having fluid communication therewith;

(b) a well tubing in said well casing forming an annulus therebetween, said tubing having its lower end in fluid communication with said production zone;

(c) a plurality of spaced-apart unloading valves in said well tubing for controlling flow of fluids from said annulus to the interior of said well tubing, each of said unloading valves containing a body of compressible liquid, said body of compressible liquid being sensitive to casing pressure, said unloading valves being identical each with the other and not adjusted with respect to pressure, depth, or temperature, each of said unloading valves being openable and closable in response to increases and decreases in casing pressure;

(d) means in said well tubing a spaced distance below the lowermost one of said plurality of unloading valves providing constant communication between said annulus and said well tubing for transfer of fluids from said annulus into said well tubing;

(e) means sealing between said well tubing and said well casing at a location between said production zone and said means providing constant communication between said annulus and the interior of said well tubing; and (f) a source of pressurized gas connected to said annulus at the surface.

13. The system of claim 12, wherein each of said unloading valves includes:

(a) a main valve for controlling transfer of gas from the annulus into the interior of the well tubing, said main valve having means for biasing it toward closing position;

(b) a liquid chamber spaced from said main valve;

(c) a compressible liquid in said liquid chamber;

(d) a pilot valve between said main valve and said liquid chamber for controlling flow of gas from said annulus into said well tubing, said pilot valve being exposed to the pressure of fluids in the annulus at all times, said pilot valve causing said main valve to remain open so long as the casing pressure remains at a relatively constant level and above an adequate value, and causing closing of the main valve when the casing pressure is reduced sufficiently over a period of time ranging from about 10 seconds to 90 seconds.

14. The system of claim 13, wherein said seal means for sealing the annulus above said production zone is a well packer, and each of said unloading valves is provided with check valve means for preventing fluid flow from said well tubing to said annulus.

15. The system of claim 14, wherein compressible liquid is silicone fluid, and a movable partition or separator separates said silicone fluid from fluids from the annulus, and said means providing constant communication between said annulus and said well tubing is an orifice valve having a check valve therein for preventing fluid flow from said tubing to said annulus.

16. The system of claim 15, wherein said movable partition or separator is a bellows of pliable elastomeric material.

17. The system of claim 15, wherein said movable partition is a piston slidably mounted in a bore in said pilot valve and sealed with a seal ring carried in a suitable recess thereon.

18. The system of claim 12, 13, 14, 15, 16, or 17, wherein said well tubing is provided with suitable landing receptacles for said unloading valves and said orifice valve, and said unloading valves and said orifice valve are installable therein and removable therefrom through use of wireline and wireline tools.

19. The system of claim 18 wherein each of said receptacles is a side pocket mandrel.

20. The system of claims 12, 13, 14, 15, 16, or 17, wherein said unloading valves and said orifice valve are mounted on the exterior of said well tubing.

21. A method of placing a well on gas lift, the well having a casing penetrating a production zone and having fluid communication therewith, said casing containing liquid, said method including the steps of:

(a) assembling a well tubing and lowering it into said casing of said well to form an annulus therebetween, said well tubing including:

(i) external seal means near its lower end, (ii) orifice means communicating the exterior of said tubing with the interior thereof a spaced distance above said external seal means, and (iii) a plurality of unloading valves spaced above said orifice means and spaced from each other and from the surface, said unloading valves being identical with each other and placed in said well tubing without adjustment with respect to depth, pressure, or temperature;

(b) actuating said external seal means at a location above said production zone to sealingly engage between said tubing and said casing;

(c) sealing between the well tubing and casing at the surface;

(d) communicating the annulus with a source of pressurized gas and injecting gas into the annulus at a substantially constant rate equal to about 125 to 175 percent of the flow capacity of one of said unloading valves while the upper end of the tubing is open to allow liquids to be discharged therethrough from the well as the liquid level in the annulus is depressed, each unloading valve closing and remaining closed soon after the liquid level in the casing is depressed to the next lower valve, until finally the liquid level reaches said orifice means and gas is injected therethrough into said well tubing; and then (e) reducing the gas injection rate to a predetermined rate commensurate with good gas lift practices for gas lifting fluids from the well.

22. The method of claim 21, wherein each of said plurality of unloading valves in step (a)(iii) is provided with a main valve for controlling the flow of fluids from said annulus into said well tubing, a pilot valve for controlling the actuation of said main valve, and a chamber containing a compressible liquid, said compressible liquid being subject to the pressure in said annulus at all times, and said pilot valve operating in response to changes in the volume of said compressible liquid.

23. The method of claim 22, wherein said orifice means in step (a)(ii) is an orifice valve.

24. The method of claim 23, wherein the orifice valve and the unloading valves of steps (a)(ii) and (a)(iii) each are provided with check valve means for preventing fluid flow from the interior of said well tubing into said annulus.

25. The method of claim 21, 22, 23, or 24, wherein said step of assembling said well tubing includes attaching landing receptacles therein for receiving said unloading valves and said orifice valve.

26. The method of claim 25, wherein said receptacles for receiving said unloading valves and said orifice valve are side pocket mandrels.

27. The method of claim 21, 22, 23, or 24, wherein said step of assembling said well tubing includes attaching mandrels therein and each of said unloading valves and said orifice valve is mounted on the exterior of one of said mandrels.

* * * * *